United States Patent [19]

Fuhrmann

[11] 4,174,687

[45] Nov. 20, 1979

[54] BRAKING DEVICE FOR FOUR-STROKE CYCLE RECIPROCATING PISTON INTERNAL COMBUSTION ENGINE

[75] Inventor: Wolfgang Fuhrmann, Nuremberg, Fed. Rep. of Germany

[73] Assignee: Maschinenfabrik Augsburg-Nürnberg Aktiengesellschaft, Nuremberg, Fed. Rep. of Germany

[21] Appl. No.: 864,520

[22] Filed: Dec. 27, 1977

[30] Foreign Application Priority Data

Dec. 24, 1976 [DE] Fed. Rep. of Germany ..... 2658927

[51] Int. Cl.[2] ..... F02L 9/02; F02D 31/00

[52] U.S. Cl. ..... 123/90.13; 123/97 B; 123/98

[58] Field of Search ..... 123/90.12, 90.13, 90.16, 123/97 R, 97 B, 103 R, 98, 111, 113, 114, 116

[56] References Cited

U.S. PATENT DOCUMENTS

| | | | |
|---|---|---|---|
| 1,696,984 | 1/1929 | Trbojevich | 129/90.12 |
| 1,903,328 | 4/1933 | Noble | 123/90.13 |
| 3,220,392 | 11/1965 | Cummins | 123/90.12 |
| 3,534,718 | 10/1970 | Pasquin | 123/90.13 |

*Primary Examiner*—Ronald H. Lazarus

*Assistant Examiner*—Craig R. Feinberg

*Attorney, Agent, or Firm*—Becker & Becker, Inc.

[57] ABSTRACT

A braking device for four-stroke cycle reciprocating piston internal combustion engines, especially vehicle engines, which for controlling at least each outlet valve include a hydraulically operable driving cylinder-piston unit adapted to be actuated by a camshaft, and a working cylinder-piston unit connected through at least one control conduit with the driving cylinder-piston unit and operable to actuate the outlet valve. The working cylinder-piston unit has a two-step different diameter cylinder and two plungers of correspondingly different diameters reciprocating relative to each other in the two-step cylinder. The braking device also includes a control member, e.g., a valve spool, common to all control conduits, for selectively connecting the control conduits to and disconnecting them from different driving cylinder-piston units and working cylinder piston units to thereby establish or interrupt connection between different driving cylinder-piston units with different working cylinder-piston units. The larger plungers only of the two plungers of the working cylinder-piston units are adapted to be acted upon by pressure fluid to reduce the opening stroke of the discharge valves.

7 Claims, 3 Drawing Figures

BRAKING DEVICE FOR FOUR-STROKE CYCLE RECIPROCATING PISTON INTERNAL COMBUSTION ENGINE

The present invention relates to a braking device for four-stroke cycle reciprocating piston internal combustion engines, especially for vehicle motors which for controlling at least each outlet valve comprise a cam operated hydraulically working driving cylinder and an outlet valve operating working cylinder which is connected to said driving cylinder by at least one control conduit.

Presently it is generally customary to use the driving motor of vehicles, especially of trucks, for braking such vehicles when the same move downhill. To this end, a throttle valve is built into the exhaust conduit. If the exhaust conduit is closed by the brake pedal, the cylinders push the combustion gases outwardly against the accumulation pressure which builds up in front of the throttle valve.

Such arrangements, however, have a number of drawbacks among which could be mentioned in particular the fact that in the discharge conduit oscillations of the gases build up which cause a fluttering of the respective outlet valves which are not in motion. This, however, considerably reduces the lifespan of such arrangements.

For this reason it has been suggested to employ mechanically controlled outlet valves of internal combustion engines as throttle valves. In conformity with this suggestion, these mechanically controlled outlet valves during the braking operation are opened only by a fraction of their normal stroke. However, the control is relatively complicated and expensive and it is for this reason that the said last mentioned arrangement has not been adopted in practice.

It has furthermore been suggested that in order to obtain a genuine braking effect when employing the outlet valves as throttling valves, it would be expedient to advance the valve opening period during the braking operation with regard to the normal opening time so that the air compressed in the cylinders would be expanded at a minimum whereby the motor recovers energy. This, however, would practically nullify a braking effect. The ideal situation in this respect would be realized when the outlet valves would already be opened during the braking effect as soon as the expansion starts in the cylinders. This, however, is not possible from a practical standpoint because the pistons will in their upper dead center position not leave sufficient space for opening the valves. Thus, only a compromise could be strived for inasmuch as the valve opening period by use of pre cams is advanced as far as possible while pockets are provided in the piston or cylinder heads so that the valves cam immerse. A motor designed according to these findings, however, have not yet become known.

As mentioned above, the present invention relates to internal combustion engines in which at least the outlet valves are hydraulically controlled by having each cam of a camshaft acting upon a piston of a driving cylinder by means of which the pressure medium is displaced at least through the intervention of a control conduit in a working cylinder, the piston of which again presses upon the valve push rod and opens the latter. Such an arrangement has become known, for instance by German Auslegeschrift No. 1264857.

It is, therefore, an object of the present invention for an internal combustion engine of the above mentioned type to provide a braking device by means of which in a simple and safe manner during the braking operation there will be realized an advance of the valve opening time for the outlet valves as well as a reduction in the valve stroke so that an effective braking will be assured.

These and other objects and advantages of the invention will appear more clearly from the following specification in connection with the accompanying drawings, in which.

Figure 3:
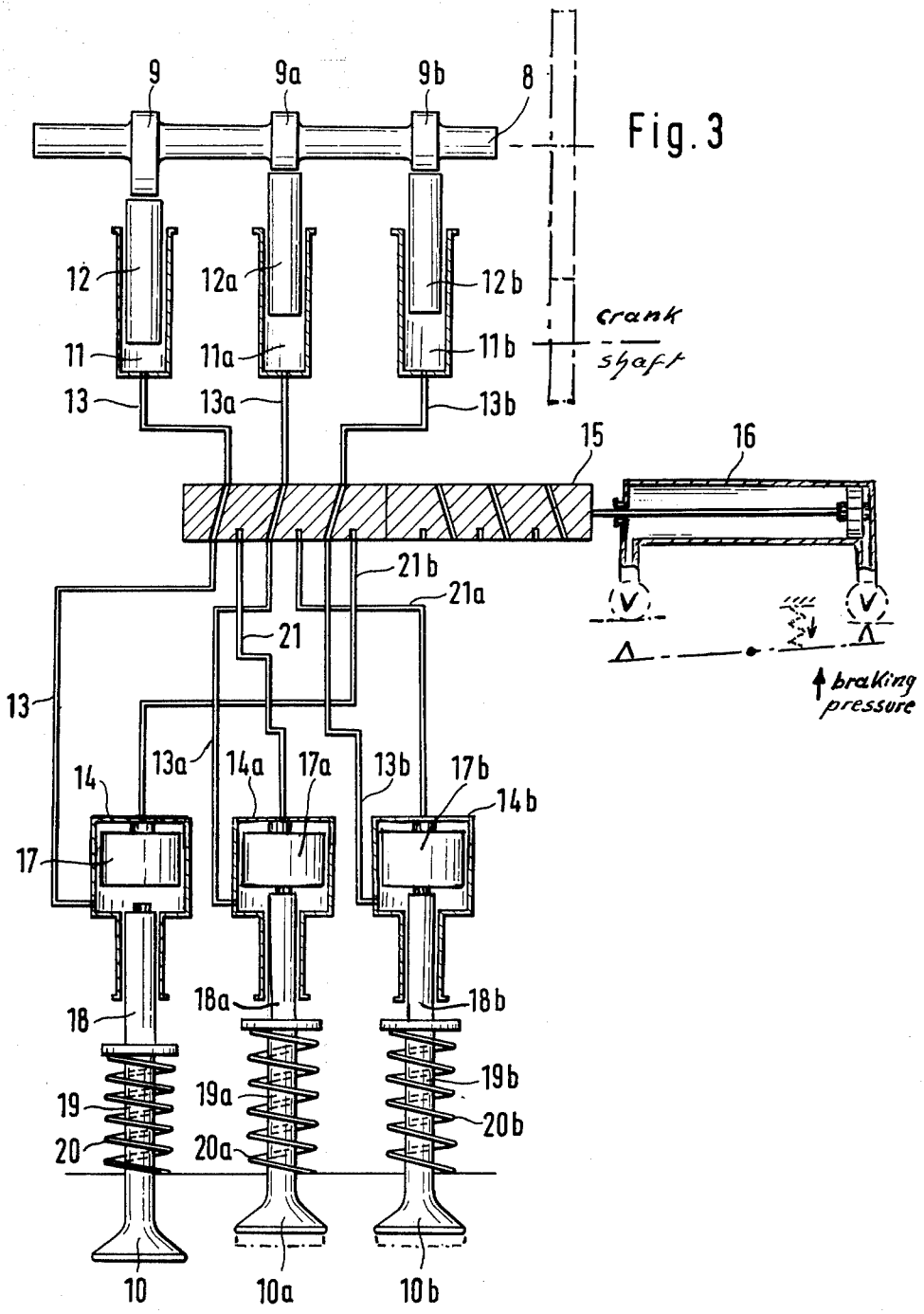

FIG. 3 diagrammatically illustrates a braking device according to the present invention.

The braking device according to the present invention is characterized primarily in that working cylinders are designed as stepped cylinders each with two pistons of differently sized diameter, and is furthermore characterized in that all control conduits have associated therewith a common control member which is operated when shifting over to a motor brake operation. By means of said control member, the working cylinders are respectively connectable to driving cylinders advancing the working cycle, and simultaneously only those pistons of the working cylinders which have the greater diameters are adapted to be acted upon by pressure media for reducing the opening stroke of the outlet valves. This solution to the problem underlying the present invention is safe and inexpensive because primarily only one change is necessary with regard to the anyhow necessary working cylinders in addition to the provision of an additional control member.

More specifically, according to the present invention it is suggested to design the pistons of the working cylinders as pistons loosely guided in the cylinders while in each instance the piston which has the smaller diameter directly engages the end face of the push rod of the pertaining outlet valve, while the larger piston located behind or above said last mentioned outlet valve, the smaller piston, and the valve push rod are located on a common longitudinal axis.

Each working cylinder is now connected to the control member by means of two control conduits in such a way that when the engine is operated by a driving cylinder acting thereupon, the larger piston of the working cylinder is adapted by the pressure medium to be displaced into its inactive position and the smaller piston is adapted to be displaced into the position in which the pertaining outlet valve is fully open. Following the shifting of the control member to motor-braking operation, only the larger piston in reverse moving direction is acted upon so that through the intervention of the smaller piston, the outlet valve opens by a partial stroke. The ratio of this partial stroke of the outlet valve when the larger piston is acted upon to its maximum opening stroke equals the ratio of the acted upon surface of the larger piston to the acted upon surface of the smaller piston.

According to a further development of the present invention, it is suggested to design the control member as a valve or slide which for each driving cylinder has a two-way valve. The shifting over or reversing of the control member is expediently effected automatically by actuating the vehicle brake pedal.

If, as is customary with four-stroke cycle engines, the camshaft actuating the driving cylinders during two revolutions of the crankshaft will carry out only one revolution, it is furthermore suggested according to the invention, that by shifting the control member to motor braking operation, the working cylinders are connectable to the driving cylinders, which driving cylinders, during their ignition interval between 45° and 90°, preferably 75° cam angle, are actuated by the cam earlier than the driving cylinders pertaining thereto during motor operation so that the outlet valves cannot collide with the pistons.

A certain cam angle cannot be fixed because such cam angle respectively depends on the number of cylinders of the engine and of the ignition sequence. Expediently, while maintaining the above mentioned finding, for instance, with a six-cylinder engine, that driving cylinder will be selected which during motor operation previously opens its pertaining outlet valve which means an advancing or forward shift of the valve opening time at braking operation by a 60° cam angle. With an eight-cylinder engine, an offset about one or two drive shafts will be selected whereby an advance of 45°–90° cam angle will be obtained. With a ten-cylinder engine, an advance by two driving cylinders corresponds to a displacement of a 70° cam angle, and with a twelve-cylinder engine, an offset by two or three driving cylinders will be selected whereby an advance of the outlet valve opening period by 60° and 90° cam angle is obtained.

It may also be mentioned that the engines also comprise a control for a mere advance of the opening period for outlet valves without reducing the stroke which relative to the described control is simplified merely by the fact that the working cylinders remain one-step cylinders in conformity with German Auslegeschrift No. 1264857, and from the control member to the working cylinders also only one control conduit is necessary. The control circuit has not been described in detail merely because an advance of the opening stroke alone does not solve the problem according to the invention.

Figure 1:
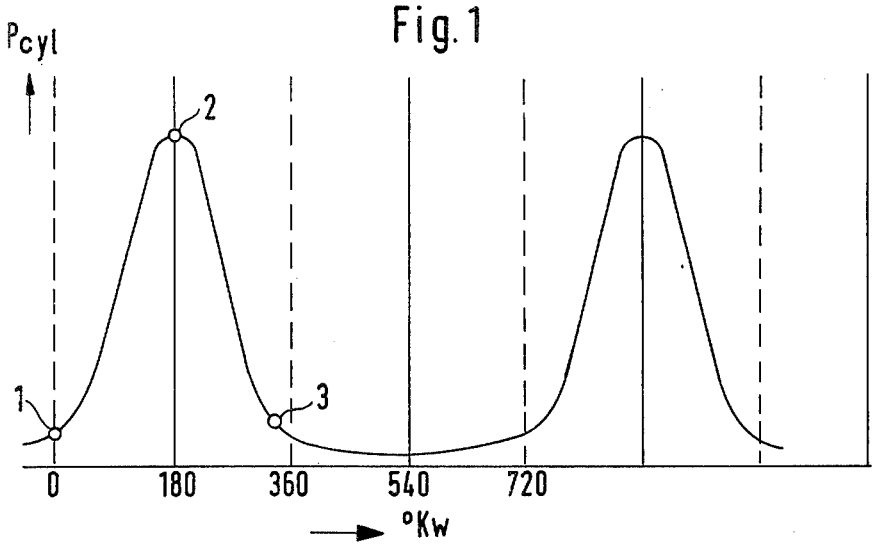
FIG. 1 illustrates a graph reflecting the course of the pressure in a cylinder of an internal combustion engine.

Referring now to the drawings in detail, FIG. 1 shows a graph according to which the pressure P in a cylinder of the internal combustion engine is plotted over the ordinate, whereas the degrees of the crank angle °Kw are plotted over the abscissa.

From point 1 to point 2, in customary manner, the compression is effected. From point 2 to point 3 the expansion occurs, and subsequently there is effected the discharge of the exhaust gases and the intake stroke is effected which, however, is not of any interest at this time.

Figure 2:
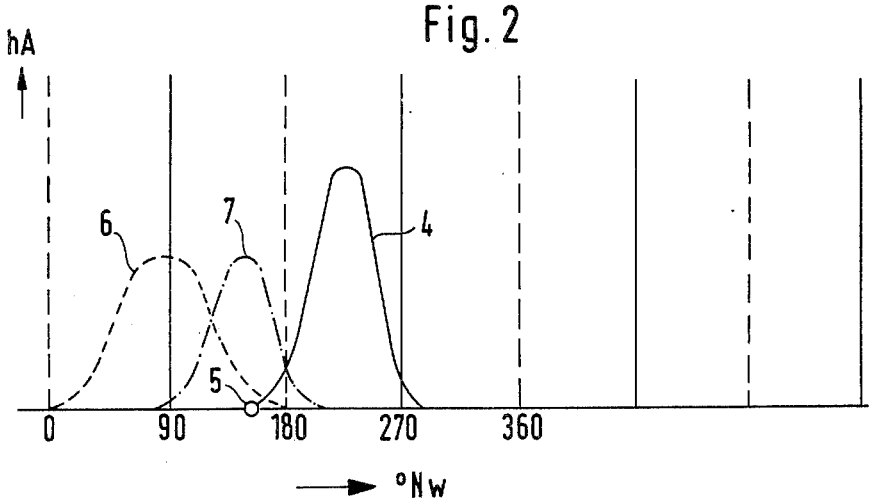
FIG. 2 is a graphic comparison of different outlet-valve openings.

In FIG. 2, the lifting stroke $h_A$ of an outlet valve is plotted over the ordinate in conformity with the degrees camshaft °W plotted over the abscissa. When viewing FIGS. 1 and 2 together, it will be seen from the solid line 4 in FIG. 2, that the outlet valve starts opening at point 5 which means closely after the almost completed expansion in the cylinder. The height of curve 4 indicates that the valve for discharging the exhaust gases is fully opened. The dash line 6 indicates the ideal situation how an outlet valve should be opened during the braking operation. Aside from the fact that the valve opens only in part, the start of the valve opening is located about the same point as the start of the compression in the cylinder, whereas the end of the opening coincides approximately with the end of the expansion. In this way, the motor could not recover any energy which means that the braking effect would have reached its maximum. However, as mentioned above, such control is practically not possible. According to the invention, the valve opening time is therefore located in about the middle between the two described curves and is indicated by the dot-dash curve 7. This means an advance of the point 5 by about 75° Nw and 150° Kw.

FIG. 3 shows a camshaft 8 driven by the internal combustion engine now shown. The camshaft 3 has three cams 9,9*a*,9*b* for controlling three outlet valves 10, 10*a*, 10*b* of the non-illustrated cylinders. Each cam 9, 9*a*, 9*b* has associated therewith a hydraulic driving cylinder 11, 11*a*, 11*b* with pistons 12, 12*a*, 12*b* respectively. Control conduits 13, 13*a*, 13*b* respectively lead to working cylinders 14, 14*a*, 14*b* which are designed as two-step cylinders. Between all control conduits 13, 13*a*, 13*b* there is provided a control valve 15 which is common to all of said control conduits 13, 13*a*, 13*b* and comprises three two-way valves. The control valve 15 is adapted to be shifted by a control cylinder 16 operable by the brake pedal on the vehicle.

In each working cylinder 14, 14*a* and 14*b* are respectively freely movably arranged pistons 17, 17*a*, 17*b* with a greater diameter and pistons 18, 18*a*, 18*b* with a smaller diameter. The control conduits 13, 13*a*, 13*b* lead into a chamber between said two pistons. The ends of the pistons 18, 18*a*, 18*b* which lead outwardly in a pressureless condition loosely engage the end faces of the surface push rods 19, 19*a*, 19*b* of the outlet valves 10, 10*a*, 10*b* which outlet valves are by means of springs 20, 20*a*, 20*b* kept at their closing position.

Finally, from the outside of the control valve 15, three further control conduits 21, 21*a*, 21*b* lead into the working cylinders 14, 14*a*, 14*b* respectively in such a way that they can convey a pressure medium only to the larger pistons 17, 17*a*, 17*b* respectively, and more specifically from the other side than the control conduits 13, 13*a*, 13*b*. Furthermore, by means of said control conduits, the association of the working cylinders 14, 14*a*, 14*b* with the driving cylinders 11, 11*a*, 11*b* exchangeable.

OPERATION

With normal operation of the engine, the control valve 15 occupies the position shown in FIG. 3 in which the control valve 15 connects the driving cylinders 12, 12*a*, 12*b* through control conduits 13, 13*a*, 13*b* respectively with the pertaining working cylinders 14, 14*a*, 14*b*. Cam 9 is shown to act upon the piston 12 of the driving cylinder 11 and transmits the pressure medium to the working cylinder 14 in such a way that the piston 17 is pressed upwardly into its inactive position whereas the piston 18 is pressed downwardly into its effective position in which it opens the outlet valve 10 to its full extent. The cams 9*a*, 9*b* on the other hand occupy their inactive position. Consequently by means of springs 20*a*, 20*b*, the outlet valves 10*a*, 10*b* are kept in their closing position whereas the pistons 18*a*, 18*b* as well as 17*a*, 17*b* are kept in their inactive position.

If it is desired to brake the motor, the control cylinder 16 displaces the control valve or valve spool 15 in FIG. 3 toward the left. As a result thereof, the driving cylinder 11 is through control conduit 21 connected to the working cylinder 14*a* while the cylinders 11*a*, 11*b* communicate with cylinders 14*b*, 14 respectively. Thus, an exchange of the cylinders is effected whereby the desired change of the opening times for the outlet valves 10, 10*a*, 10*b* is realized. Furthermore, the thus exchanged driving cylinders 11, 11*a*, 11*b* act through conduits 21, 21*a*, 21*b* only upon the pistons 17*a*, 17*b*, 17 of larger diameter whereby these pistons when being acted upon by the same quantity of a pressure medium, are displaced by a considerably shorter stroke to the abutment. Inasmuch as the pistons 17*a*, 17*b*, 17 press the pistons 18*a*, 18*b*, 18 of smaller diameter downwardly, the outlet valves 10*a*, 10*b*, 10 are opened only by a portion of its maximum stroke.

It is, of course, to be understood that the present invention is by no means limited to the specific showing in the drawings but also comprises any modifications within the scope of the appended claims.

What I claim is:

1. In combination with a cam shaft and outlet valve means of a four stroke cycle reciprocating piston internal combustion engine, a braking device which includes: fluid displacing actuating cylinder-piston means operable by said cam shaft, fluid operable two-step control cylinder-piston means for controlling said outlet valve means, each of said control cylinder piston means comprising two different diameter bores with two correspondingly different diameter pistons each reciprocating relative to and independently of the other, the shorter diameter piston of the last mentioned two different diameter pistons having one end face facing an adjacent oppositely located endface of the pertaining larger diameter piston and being located closer to said valve means than the larger diameter piston of said last mentioned two different diameter pistons, control means interposed between said actuating cylinder-piston means and said control cylinder-piston means, first conduit means leading from said actuating cylinder-piston means to said control means, second conduit means leading from said control means to said control cylinder piston means for fluid communication with those piston areas of said larger diameter and shorter diameter pistons which face each other, third conduit means leading from said control means to that surface of said larger diameter piston of said two-step control cylinder piston-means which faces away from the pertaining shorter diameter piston, said control means including a reciprocating member having first passage means therein and being movable into a first control position to make said first passage means effective for establishing fluid communication between said first and second conduit means, said reciprocating member also being movable into a second control position to make said second passage means effective to establish fluid communication between said first and third conduit means, the arrangement being such that in said second control position of said reciprocating member the respective connection of said third conduit means with said second passage means is effected in a different order than the connection of said second conduit means with said first passage means in said first control position of said reciprocating member when in both position looking in the same direction with regard to the longitudinal extension of said reciprocating member thereby in said second control position of said reciprocating member advancing the opening point of said outlet valve means while reducing the maximum opening stroke of said outlet valve means.

2. An arrangement according to claim 1, in which said reciprocating member is operatively connected with a foot operable braking element, means associated with said braking element being provided for continuously urging said reciprocating member to its first control position.

3. An arrangement according to claim 1, in which a cam shaft completes one revolution when said crankshaft completes two revolutions, and in which in response to said reciprocating member occupying its second control position the opening start of of said outlet valve means is advanced by a cam angle of from 45° to 90° over the opening start when said reciprocating member occupies its first control position.

4. An arrangement according to claim 3, in which said advanced opening angle is about 75° cam angle.

5. An arrangement according to claim 1, in which said outlet valve means include pushrod means having an endface directly engageable by that endface of the smaller diameter piston which is remote from that endface of the same smaller diameter piston that faces the adjacent endface of the pertaining larger diameter piston, and in which said control cylinder-piston means comprise a plurality of stepped cylinders each having reciprocally arranged therein a larger diameter piston and a smaller diameter piston movable independently of said larger diameter piston, each of said control cylinder-pistons having its larger diameter piston and its shorter diameter piston and its pushrod means arranged in axial alignment with each other.

6. An arrangement according to claim 5, in which each control cylinder-piston means is by said second and third conduit means so connected to said control means that in response to said reciprocating member occupying its first control position the respective larger diameter piston is moved into an ineffective position whereas the shorter diameter piston moves the pertaining outlet valve means into its fully opened position, and in which in response to said reciprocating member occupying its second control position the respective shorter diameter piston lifts the pertaining outlet valve means only partially.

7. An arrangement according to claim 6, in which in response to said reciprocating member occupying its second control position the ratio of the partial opening stroke of the pertaining outlet valve means to the full opening stroke of said last mentioned outlet valve means substantially equals the ratio of the fluid pressure acting upon the surface of the greater diameter piston to the fluid pressure acting upon the surface of said shorter diameter piston.

* * * * *